United States Patent [19]

Wells

[11] Patent Number: 4,645,100

[45] Date of Patent: Feb. 24, 1987

[54] DISPENSING SPIGOT

[75] Inventor: Peter R. Wells, Ashhurst, New Zealand

[73] Assignee: Wrightcel Limited, Australia

[21] Appl. No.: 665,368

[22] Filed: Oct. 26, 1984

[30] Foreign Application Priority Data

Oct. 27, 1983 [AU] Australia ..... PG2086

[51] Int. Cl.[4] ..... B65D 47/20

[52] U.S. Cl. ..... 222/505; 222/517; 222/563; 251/299; 251/342

[58] Field of Search ..... 222/498, 501, 499, 511, 222/517, 512, 542, 528, 529, 562, 563, 532; 251/349, 354, 342, 111, 114, 115, 348, 89, 299, 298; 215/301; 220/260, 306; 222/505

[56] References Cited

U.S. PATENT DOCUMENTS

| | | | |
|---|---|---|---|
| 3,712,519 | 1/1973 | Collie | 222/563 |
| 3,776,434 | 12/1973 | Christensen et al. | 222/563 X |
| 3,972,452 | 8/1976 | Welsh | 222/511 X |
| 4,105,141 | 8/1978 | Lane et al. | 222/563 X |
| 4,169,548 | 10/1979 | Bond | 222/511 X |
| 4,248,362 | 2/1981 | Welsh et al. | 222/511 X |
| 4,362,255 | 12/1982 | Bond | 222/542 X |
| 4,444,340 | 4/1984 | Bond et al. | 222/498 |

FOREIGN PATENT DOCUMENTS

| | | | |
|---|---|---|---|
| 651075 | 3/1951 | United Kingdom | 222/542 |

*Primary Examiner*—Joseph J. Rolla
*Assistant Examiner*—Kevin P. Shaver
*Attorney, Agent, or Firm*—Lowe, Price, LeBlanc, Becker & Shur

[57] ABSTRACT

A dispensing spigot for a container in which the spigot 15 is mounted on a spout 10 and a portion 18 of the deformable diaphragm wall 19 sealingly engages the internal surface of the spout wall 12. To improve sealing a groove 21 is provided in the diaphragm wall and a flange 14 projects from the spout wall 12 into the groove 21 to sealingly engage the surface 23 of groove 21. This arrangement of the flange 14 and groove 21 restricts leakage between the spout 12 and the deformable wall 18.

6 Claims, 3 Drawing Figures

DISPENSING SPIGOT

Figure 1:
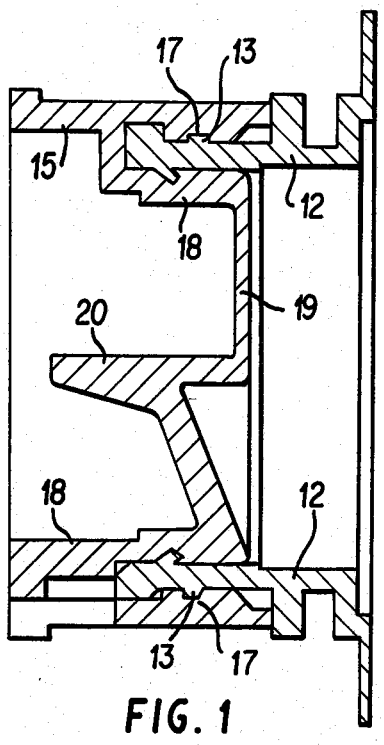

This invention relates to dispenser spigots for bag in the box fluid containers.

Australian Pat. No. 446218 (Fattori) discloses a spigot having a diaphragmatic transverse wall of concave shape which is inserted into the spout of the container outlet and sealingly engages the outer lip of the spout. Deformation of the concave wall breaks the sealing engagement to allow dispensing of the liquid contents through the spout.

A difficulty with the Fattori tap is that the outer lip of the spout can be damaged and this allows leakage to occur. One attempt to solve this problem was offered by Welsh in Australian Pat. No. 474900 which discloses a spigot in which the concave wall of the diaphragm is extended by a flange to increase the surface contact between the spout and the deformable wall of the spigot. A difficulty with the Welsh spigot is the increase in the material needed to form the spigot and the consequential increase in costs.

Another attempt to avoid leakage in the Fattori type spigot was provided by Scholle in Australian Pat. No. 510198. In this proposal the outer surface of the deformable wall of the spigot was provided with a sealing bead. The Scholle solution was to increase the pressure at a line of contact between the inner wall of the spout and the outer wall of the diaphragm. A difficulty with this improvement is that like the Fattori spigot any damage or cracks in the bead would enable leakage to occur.

It is an object of this invention to provide a means of improving leakage resistance in spigot dispensers of the type which includes a diaphragmatic concave wall.

To this end the present invention provides in combination a container having a spout and a dispensing spigot attached to said spout for dispensing the contents of the container, said spigot including a concave diaphragm wall adapted to fit within said spout such that the external surface of the diaphragm wall engages the inner surface of the spout the improvement comprising the provision of a groove in either the inner surface of the spout or the outer surface of the diaphragm wall and a complementary flange on the other of said two surfaces such that the surface of the flange sealingly engages a portion of the surface of the groove.

In this invention there is sealing engagement provided between the outer surface of the diaphragm wall and the internal surface of the spout and this is enhanced by provision of a surface (as opposed to a line) contact for sealing proposed between the flange and the surface of the groove. This provides a longer sealing surface which provides a longer and more devious leakage path, thus reducing the possibility of leaks.

Preferably the groove is provided in the outer surface of the diaphragm wall and the flange is provided on the inner surface of the spout. The groove is preferably V shaped such that the flange projects into the groove and lies along one surface of the V. Ideally the end of the flange engages the other wall of the groove to increase sealing contact.

The spigot is composed of any suitable elastomeric material suitable for forming an integral spigot and which will provide the diaphragm wall with the desired flexibility and resilience to enable it to function.

Figure 2:
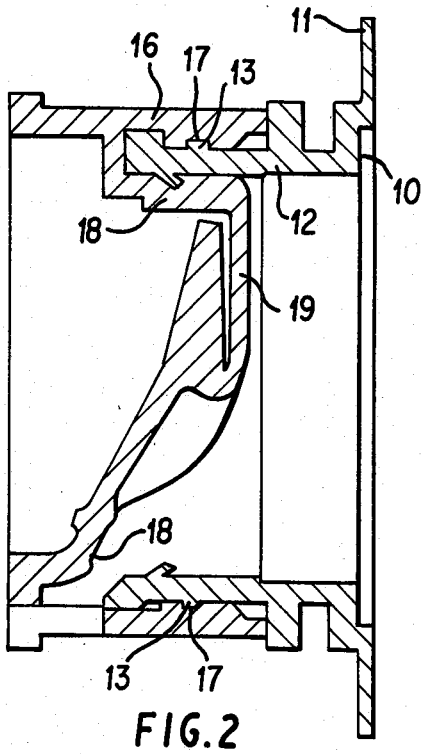
Figure 3:
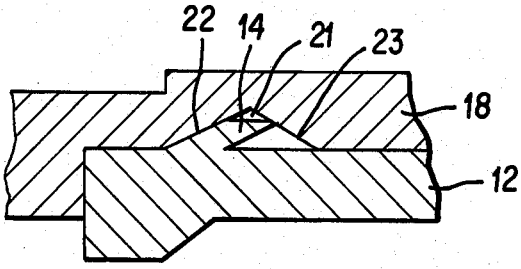
Figure 4:
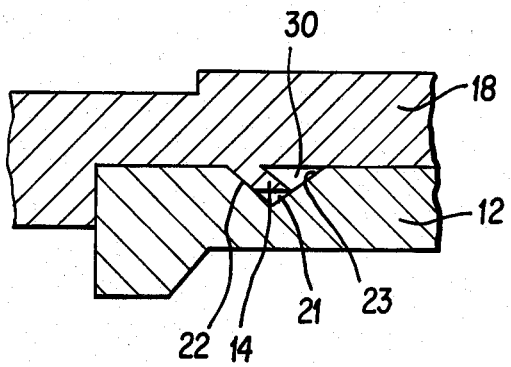

A preferred embodiment of the invention will now be described with reference to the drawings in which FIG. 1 is a schematic cross-sectional view of a spigot and spout assembly, FIG. 2 is a similar view with the diaphragm in its dispensing position and FIG. 3 shows a detailed view of the sealing arrangement between the spigot and the spout and FIG. 4 shows a detailed view of an alternative sealing arrangement between the spigot and the spout.

The dispensing arrangement comprises a cylindrical spout 10 attached by flanges 11 to a flexible container. The cylindrical dispensing spigot 15 is composed of resilient plastics material and fits onto the spout 10 such that the outer wall 16 encompasses the spout wall 12 and is held in position by the interfitting of bead 13 on the external surface of wall 12 with the recess 17 on the inner surface of the outer wall 16.

The spigot 15 includes a diaphragm wall 19 connected by the inner side wall 18 to the outer wall 16. The inner side wall 18 and the diaphragm wall 19 are distorted by manipulation of the lever 20 as shown in FIG. 2.

Closure of the dispensing spigot is achieved by the contact between the internal surface of the spout wall 12 and the external surface of the inner side wall 18. Sealing is assured by the engagement of the sealing flange 14 and the groove 21. The sealing flange 14 as illustrated is on the inner surface of spout wall 12 and provides a sealing contact with the groove 21 on the outer surface of the side wall 18 along the surface 22 of the groove 21. The flange 14 incorporates a point which sealingly engages the surface 23 of the grooved 21. Preferably the groove 21 is triangular in section and comprises two side surfaces 22 and 23.

Alternatively, as shown in FIG. 4 the groove 21 could be provided on the inner surface of the spout wall 12 and the sealing flange could be located on the external surface of the inner side wall 18.

From the above it can be seen that the sealing arrangement of this invention provides an alternative means for reducing the likelihood of leakage.

The claims defining the invention are as follows:

1. A container having a spout and a dispensing spigot attached to said spout for dispensing contents of the container, said spigot including a concave diaphragm wall fitting within said spout such that an external surface of the diaphragm wall engages an inner surface of the spout, the improvement comprising a V-shaped groove formed in the external surface of the diaphragm wall and a complementary flange formed on the inner surface of the spout and projecting into said groove, one surface of said flange being in sealing contact with one side of the V-shaped groove, said flange being an elongate member in a direction projecting away from its associated inner surface of the spout and at an acute angle thereto, the length of said elongate member being greater than the thickness thereof, the length of said flange being formed between said one surface and a generally parallel second surface connected by an end wall of the flange, said second surface and said end wall being joined at a pointed edge, said pointed edge engaging the other side of said V-shaped groove, whereby sealing is achieved along (1) substantially the entire surface of said one surface of the flange and (2) between the pointed edge of said flange with said other side of said V-shaped groove.

2. The container of claim 1, wherein said end wall constitutes a free end of the flange.

3. The container of claim 1, wherein said second surface of the flange formed opposite and generally parallel to said one surface defines a closed space with said other side of the V-shaped groove.

4. A container having a spout and a dispensing spigot attached to said spout for dispensing contents of the container, said spigot including a concave diaphragm wall fitting within said spout such that an external surface of the diaphragm wall engages an inner surface of the spout, the improvement comprising a V-shaped groove formed in the inner surface of the spout of the diaphragm wall and a complementary flange formed on the external surface of the diaphragm wall and projecting into said groove, one surface of said flange being in sealing contact with one side of the V-shaped groove, said flange being an elongate member in a direction projecting away from its associated external surface of the diaphragm wall and at an acute angle thereto, the length of said elongate member being greater than the thickness thereof, the length of said flange being formed between said one surface and a generally parallel second surface connected by an end wall of the flange said second surface and said end wall being joined at a pointed edge, said pointed edge engaging the other side of said V-shaped groove, whereby sealing is achieved along (1) substantially the entire surface of said one surface of the flange and (2) between the end said of said flange with said other wall of said V-shaped groove.

5. The container of claim 4, wherein said end wall constitutes a free end of the flange.

6. The container of claim 4, wherein said second surface of the flange formed opposite and generally parallel to said one surface defines with said other side of the V-shaped groove a closed space.

* * * * *